US006992058B2

(12) United States Patent
Grandmaire et al.

(10) Patent No.: US 6,992,058 B2
(45) Date of Patent: Jan. 31, 2006

(54) AQUEOUS COMPOSITION COMPRISING OLIGOMERIC ESTERQUATS

(75) Inventors: Jean-Paul Grandmaire, Andrimont (BE); Anita Hermosilla, Othee (BE)

(73) Assignee: Colgate-Palmolive Company, New York, NY (US)

( * ) Notice: Subject to any disclaimer, the term of this patent is extended or adjusted under 35 U.S.C. 154(b) by 45 days.

(21) Appl. No.: 10/793,102

(22) Filed: Mar. 4, 2004

(65) Prior Publication Data

US 2005/0037944 A1 Feb. 17, 2005

Related U.S. Application Data

(63) Continuation-in-part of application No. 10/766,785, filed on Jan. 27, 2004, which is a continuation-in-part of application No. 10/452,555, filed on Jun. 2, 2003, which is a continuation-in-part of application No. 10/288,134, filed on Nov. 5, 2002, which is a continuation-in-part of application No. 10/286,616, filed on Nov. 1, 2002, now abandoned.

(51) Int. Cl.
*C11D 1/62* (2006.01)

(52) U.S. Cl. ..... 510/515; 510/504; 510/329; 510/330; 510/473

(58) Field of Classification Search ..... 510/515, 510/504, 329, 330, 473
See application file for complete search history.

(56) References Cited

U.S. PATENT DOCUMENTS 6,300,307 B1 * 10/2001 Bermejo et al. ..... 510/499
6,432,895 B1 * 8/2002 Bigorra et al. ..... 510/123
6,465,419 B1 * 10/2002 Bermejo Oses et al. .... 510/515

FOREIGN PATENT DOCUMENTS

| | | |
|---|---|---|
| DE | 197 43 687 | 11/1998 |
| EP | 1 136 471 | 7/2003 |
| WO | WO 01/47489 | 7/2001 |

* cited by examiner

*Primary Examiner*—Charles Boyer
(74) *Attorney, Agent, or Firm*—Bernard Lieberman

(57) ABSTRACT

The application relates to a medium viscosity, clear fabric softening composition, comprising (a) from about 1 to 20 wt. % of an oligomeric esterquat, derived from the reaction of an alkanol amine with (i) a polycarboxylic acid; and (ii) a fatty alcohol or a fatty acid; or (iii) a mixture of a fatty alcohol and a fatty acid, followed by partial quaternization (leading to a mixture of oligomeric esteramine and of esterquat);

Figure 1:
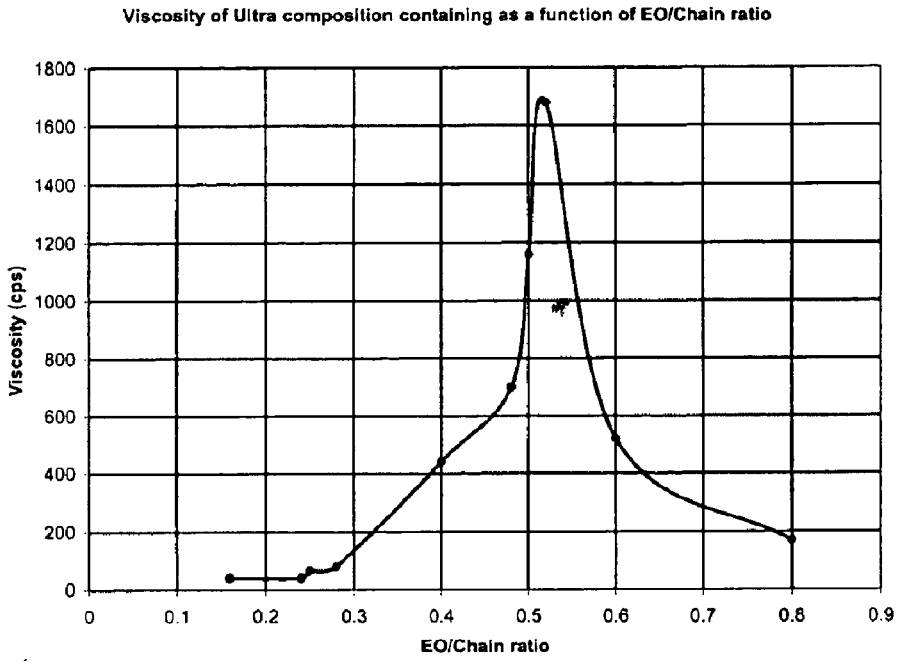

(b) at least about 0.2 wt. % dipropylene glycol, said fabric softening composition being free of isopropanol, ethylene glycol, propylene glycol and polyglycols;

(c) an effective amount of a water insoluble perfume; and (d) an effective amount of a thickening agent to provide a viscosity of from 80 to 700 mPa.s in the softening composition, said thickening agent being selected from the group consisting of (i) non-ionic water-soluble cellulosic polymer derived from the condensation of cellulose and ethylene oxide and/or propylene oxide; (ii) ethoxylated and/or propoxylated fatty alcohol polyurethane associative thickener; and (iii) cationic polyacrylate copolymer.

12 Claims, 3 Drawing Sheets

AQUEOUS COMPOSITION COMPRISING OLIGOMERIC ESTERQUATS

This application is a continuation-in-part of prior co-pending application U.S. Ser. No. 10/766,785 filed Jan. 27, 2004 currently pending which is a continuation-in-part of co-pending application U.S. Ser. No. 10/452,555 filed Jun. 2, 2003 currently pending which is a continuation-in-part of co-pending application U.S. Ser. No. 10/288,134 filed Nov. 5, 2002 currently pending which in turn is a continuation-in-part of U.S. Ser. No. 10/286,616 filed Nov. 1, 2002, now abandoned the disclosures of which are incorporated herein by reference.

TECHNICAL FIELD

The present invention is in the field of aqueous compositions, especially liquid household products, such as liquid detergents and fabric softener compositions. Particularly, the invention relates to such compositions comprising a softening agent for natural and synthetic fibers, which softening agent is based on esters derived from alkanol amines, carboxylic acids and fatty alcohols or on cationic surfactants obtainable thereof. More in detail, the present invention relates to a process for preparing a stable aqueous composition containing such softening agents, to the preparation of such a thickened stable composition, as well as to the compositions obtainable by said processes.

BACKGROUND OF THE INVENTION

Biodegradable softeners have attracted recent attention in the prior art. For instance, in German patent no. 197 43 687, in the name of Henkel KGaA, readily biodegradable detergents are described, which contain oligomeric esterquats obtained by quaternizing oligoesters of mono and di-carboxylic acids in combination with alkylene oxide adducts on fatty acid amines.

The international patent application WO-A-01/47489, in the name of Cognis Deutschland GmbH and Bigorra Llosas et al., discloses fiber brightening and softening agents comprising esterquats obtained by reacting alkanol amines with mixtures of fatty acids and dicarboxylic acids, optionally alkoxylating the resulting esters, and quaternizing the products; and auxiliary materials selected from (non)quaternized fatty acid amides, betaines, nonionic surfactants, polyols and/or their derivatives, alcohols and/or hydrotropes.

In the European patent application 1 136 471, in the name of KAO Corporation S.A., alkanol amine esters are described which are based on the esterification reaction of alkanolamines, carboxylic acids and fatty alcohols. The alkanolamines and fatty alcohols are optionally alkoxylated. In addition, the cationic surfactants and esterquats obtainable therefrom are disclosed.

The cationic surfactants and the esterquats disclosed in said European patent application have a high degree of biodegradability, but compared to the biodegradable esterquats of the prior art also exhibit a high degree of efficacy in softening and conditioning natural and synthetic fibers, such as hair, or fibers used in textiles and paper.

In a further aspect, said European patent application relates to aqueous fabric-softening compositions which contain the cationic surfactants or esterquats, optionally together with other active softening substances. Particularly, these fabric softening compositions contain, in an aqueous medium optionally containing constituents selected from those normally used in fabric softener composition: (a) cationic surfactants or esterquats obtainable from the alkanolamines described, (b) one or more cationic surfactants which are active as fabric softeners, and (c) one or more non-ionic fabric-conditioning surfactants, wherein the amount of (a)+(b)+(c) is 2–60 wt. % based on the total composition; the amount of (a), based on the total of (a)+(b)+(c), being 2–100 wt. %; the amount of (b), based on the total of (a)+(b)+(c), being 0–98 wt. %; and the amount of (c), based on the total of (a)+(b)+(c), being 0–40 wt. %.

OBJECTIVES OF THE PRESENT INVENTION

The first objective of the present invention is to provide a liquid fabric softener composition comprising an oligomeric esterquat of the type described in said EP-A-1 136 471 which fabric softener composition has a stable and reproducible viscosity.

The second objective of the present invention is to provide a liquid softener composition of said type, which has a medium viscosity. It is well known to persons skilled in the art that consumers prefer medium viscosity because it induces product richness perception. Preferably, the liquid fabric softener composition is a liquid rinse cycle composition.

It is a further objective of the present invention to provide clear fabric softener compositions.

Other objectives will become apparent from reading the following description.

SUMMARY OF THE INVENTION

The present inventors have investigated the behaviour of the oligomeric cationic surfactants and particularly the oligomeric esterquats of the type described in EP-1 136 471 in aqueous formulations. They have found that diluted and concentrated compositions comprising from about 1 wt. % to about 20 wt. % of the said oligomeric cationic surfactants or oligomeric esterquats can be formed, which are clear. They have also found that when perfumes are added to such compositions, especially when using concentrations of perfume above 0.7 wt. %, based on the weight of the final composition, or when adding perfume to such concentrated compositions containing from about 12 to 20 wt. % and especially about 15 to 20 wt. % of the softener, in the majority of cases, these perfumed compositions turn from clear or transparent compositions into hazy or milky compositions. Perfumes are generally complex, water insoluble, oily mixtures of natural or synthetic fragrance and odour compounds or compositions.

It has been found that by incorporating at least about 0.2 wt. % dipropylene glycol, drawn to the total weight of the composition, clear perfumed medium viscosity fabric softening compositions are obtained.

Viscosities of compositions described in the present description and claims are determined at room temperature (25° C.) using a Brookfield RVT viscometer (spindle 2; 50 rpm). Any percentages indicated are percentages by weight drawn to the weight of the final composition, unless otherwise indicated. The term "low viscosity", as used herein refers to a composition having a viscosity in the range of about 20–50 mPa.s. The term "medium viscosity", refers to a viscosity of about 80–700 and preferably about 100–500 mPa.s.

A low viscosity for such liquid compositions provides advantages in the preparation stage for fabric softening compositions. However, the person skilled in the art also knows that consumers prefer fabric softening compositions having a medium viscosity over low viscosity compositions.

Medium viscosities give an important aesthetic attribute that is perceived as being linked to the richness of a product; that is, medium viscosities provide a product richness perception.

EP-A-1 136 471 does not contain any specific, teachings concerning compositions which contain a perfume. It does, however, refer to dipropylene glycol (DPG). DPG is mentioned as one of the possible polyols that can be used to reduce the viscosity of the new concentrated softeners described in this document. In addition, said European patent application teaches that:

"products which serve to reduce viscosity in concentrated compositions, such as glycols compounds, for example, ethylene glycol, dipropylene glycol, polyglycols, etc."

are well known to persons skilled in the art as optional components to be added to the aqueous fabric softener compositions described therein.

However, the present inventors found that it was not known how to prepare compositions containing from about 1 to 20 wt. % oligomeric esterquat which have a stable and reproducible viscosity. In addition, the inventors have discovered that there are only a few thickening agents that will increase the viscosity of the oligomeric esterquats to the desired viscosity level and allow a clear transparent composition. It has been further discovered that perfume can be added to such clear compositions without adversely affecting the clarity provided such contain at least about 0.2 wt. % DPG.

Accordingly, the present invention provides a medium viscosity fabric softening composition, comprising:

(a) from about 1 to 20 wt. % of an oligomeric esterquat, derived from the reaction of an alkanol amine with (i) a polycarboxylic acid; and (ii) a fatty alcohol or a fatty acid; or (iii) a mixture of a fatty alcohol and a fatty acid, followed by partial quaternization (leading to a mixture of oligomeric esteramine and of esterquat);

(b) at least about 0.2 wt. % dipropylene glycol (c) from about 0.2 to 2.5 wt. % of a water insoluble perfume; and (d) from 0% to an effective amount of a thickening agent or mixture of thickening agents, selected from the group consisting of (i) non-ionic water-soluble cellulosic polymer derived from the condensation of cellulose and ethylene oxide and/or propylene oxide; (ii) ethoxylated and/or propoxylated fatty alcohol polyurethane associative thickener; and (iii) cationic polyacrylate copolymer.

DETAILED DESCRIPTION OF THE INVENTION

In a first aspect, the present invention relates to a clear, medium viscosity fabric softening composition, comprising:

(a) from about 1 to 20 wt. % of an oligomeric esterquat, derived from the reaction of an alkanol amine with (i) a polycarboxylic acid; and (ii) a fatty alcohol or a fatty acid; or (iii) a mixture of a fatty alcohol and a fatty acid, followed by partial quaternization (leading to a mixture of oligomeric esteramine and of esterquat);

(b) at least about 0.2 wt. % dipropylene glycol, said fabric softening composition being free of isopropanol, ethylene glycol, propylene glycol and polyglycols;

(c) an effective amount of a water insoluble perfume; and (d) an effective amount of a thickening agent to provide a viscosity of from 80 to 700 mPa.s in the softening composition, said thickening agent being selected from the group consisting of (i) non-ionic water-soluble cellulosic polymer derived from the condensation of cellulose and ethylene oxide and/or propylene oxide; (ii) ethoxylated and/or propoxylated fatty alcohol polyurethane associative thickener; and (iii) cationic polyacrylate copolymer.

In a preferred embodiment, the medium viscosity fabric softening composition of the present invention is a concentrate, comprising from about 12 to 20 wt. %, and preferably about 15 to 20 wt. %, of said oligomeric esterquat.

In another preferred embodiment, the medium viscosity concentrated fabric softening composition of the invention contains at least about 0.7 wt. % perfume. Perfumes are generally complex, water insoluble, oily mixtures of natural or synthetic fragrance and odour compounds or compositions.

The upper-limit of the amount of dipropylene glycol in the compositions of the present invention is not particularly critical, as long as the amount does not interfere with the intended properties of the final product. Amounts up to 10 wt. % DPG were found to be effective. Generally, however, an upper-limit of about 2 wt. % for the amount of DPG is sufficient to achieve the effect required.

Perfumes useful in the softener composition of the present invention are essentially water insoluble as mentioned above. Suitable perfume oils are mentioned in the above-identified WO-A-0 1/47489, which document is incorporated herein by reference for the description of suitable perfume oils. In addition, commercially available perfumes, such as those sold under the tradenames Peluche, Blue Diamond, Doucine, Douscent, Melba, Belle de Mai, Paradise and Green Velvet, can suitably be used in the products of the present invention.

In the preparation of the product of the present invention, use is made of a process to prepare a stable, and particularly to a viscosity stable, fabric softening composition having a low viscosity, said composition comprising 1–20 wt. % of an oligomeric esterquat, obtainable by reaction of an alkanol amine with (i) a polycarboxylic acid; and (ii) a fatty alcohol or a fatty acid; or (iii) a mixture of a fatty alcohol and a fatty acid, followed by partial quaternization (leading to a mixture of oligomeric esteramine and of esterquat), said process comprising melting said oligomeric esterquat, dispersing said melted material in hot water, and subsequently cooling.

In a suitable embodiment, the hot water has a temperature in the range between the melting point of said oligomeric esterquat and a temperature that is 30° C. higher than said melting point. It is noted in this respect that the melting point of the esterquat is generally not a sharp point but a melting range. The melting point is in the present description, the lowest temperature where the esterquat is in flowing molten state.

In preferred embodiments, the hot water has a temperature in the range between 50 and 70° C., and more particular in the range between 55 and 65° C.

The addition of molten esterquat to the hot water is carried out while stirring. The cooling step can simply be carried out by storing the mixture at ambient temperature; preferably the cooling is carried out while stirring.

By this process, fabric softening compositions comprising an oligomeric esterquat having a low viscosity are obtained, which have a stable and reproducible viscosity.

As indicated above, the viscosity of such compositions may be increased by addition of certain thickening agents that have to be selected as being compatible with the oligomeric esterquat. The thickening agents are selected from specific thickeners of groups consisting of modified cellulosic polymer, associative thickeners and cationic polyacrylate copolymer.

The present invention also relates to a process for the manufacture of a stable medium viscosity fabric softening composition, said composition comprising:

(a) from about 1 to 20 wt. % of an oligomeric esterquat, derived from the reaction of an alkanol amine with (i) a polycarboxylic acid; and (ii) a fatty alcohol or a fatty acid; or (iii) a mixture of a fatty alcohol and a fatty acid, followed by partial quaternization (leading to a mixture of oligomeric esteramine and of esterquat);

(b) at least about 0.2 wt. % dipropylene glycol, said fabric softening composition being free of isopropanol, ethylene glycol, propylene glycol and polyglycols;

(c) an effective amount of a water insoluble perfume;

(d) an effective amount of a thickening agent to provide a viscosity of from 80 to 700 mPa.s in the softening composition, said thickening agent being selected from the group consisting of (i) non-ionic water-soluble cellulosic polymer derived from the condensation of cellulose and ethylene oxide and/or propylene oxide; (ii) ethoxylated and/or propoxylated fatty alcohol polyurethane associative thickener; and (iii) cationic polyacrylate copolymer; and (e) balance water.

Without wishing to be bound to any specific theory, it is believed that the softening material as described in EP-A-1 136 471 forms a structure in the softening composition. This structure may form a complex with the perfume so that the perfume is homogenously present in the softening composition. The complex formation or at least the degree thereof is influenced by DPG.

The amount of thickening agent to be added to the thin solution prepared in the process forming the second aspect of the present invention is sufficient to bring the viscosity of the final composition in the range of about 80–700 and preferably 100–500 mPa.s.

In the fabric softening composition to be prepared other generally used additives and ingredients may be present. Particularly, conventional preservatives, sequestering and anti-oxidant agents, dyes, perfumes and ingredients delivering additional consumer benefits such as colour protection, anti-wrinkle effect, anti-bacterial effect, and so on can be added.

The medium viscosity fabric softening composition forming the first aspect of the present invention may be described as a liquid aqueous fabric softening composition comprising (i) from about 1 to 20 wt. % of an oligomeric esterquat, obtainable by reaction of an alkanol amine with (i) a polycarboxylic acid; and (ii) a fatty alcohol or a fatty acid; or (iii) a mixture of a fatty alcohol and a fatty acid, followed by partial quaternization (leading to a mixture of oligomeric esteramine and of esterquat); (ii) a specific thickening agent or mixture of thickening agents in sufficient amounts to increase the viscosity of a thin dispersion of (i) to a medium viscosity; (iii) 0.2–2.5 wt. % of a water insoluble perfume; (iv) at least 0.2 wt. % dipropylene glycol and (v) optionally preservative, sequestering or anti-oxidant agents, dye, perfume and any ingredients delivering additional consumer benefits such as colour protection agents, anti-wrinkle agents, anti-bacterial agents and so on. Conventional ingredients for fabric softening and conditioning compositions, such as clays, silicones, fatty alcohols, fatty esters and so on, may also be present.

In the fabric softening compositions of the present invention, an essential ingredient is the an oligomeric esterquat, obtainable by reaction of an alkanol amine with (i) a polycarboxylic acid; and (ii) a fatty alcohol or fatty acid; or (iii) a mixture of a fatty alcohol and a fatty acid followed by partial quaternization (leading to a mixture of oligomeric esteramine and of esterquat). The preparation of this essential ingredient is described in all details in EP-A-1 136 471, which document is incorporated in the present description by reference for describing the said ingredient and its preparation.

Preferably, the alkanol amine is triethanol amine. In a further preferred embodiment, the carboxylic acid is a polycarboxylic acid, more preferably a dicarboxylic acid. The most preferred esterquat is commercially available ex KAO and sold under the tradename Tetranyl CL-518.

It has been discovered that the selection of suitable thickening agents for the oligomeric esterquats required by the present invention is driven by the compatibility with the oligomeric esterquat and the micellar solution of this material in water. This micellar solution may encapsulate or otherwise form complexes with the perfume. Only few thickening agents have been found to be compatible with the oligomeric esterquat dispersion.

These suitable thickening agents will be described in more detail herein-below:

The first group of suitable thickeners belong to the class of modified cellulosic polymers. Suitable cellulosic polymers are non-ionic water-soluble cellulose derivatives, and particularly cellulose ethers derived from the condensation of cellulose, and especially high purity cellulose, such as cellulose derived from cotton or wood, and ethylene oxide and/or propylene oxide, but preferably ethylene oxide. Suitable modified cellulosic thickeners are commercially available under the tradename Natrosol HHX, HHXR and HHBR (ex Hercules Inc, USA). In a preferred embodiment, the thickening agent comprises non-ionic water-soluble cellulose ether formed by reaction of cellulose and ethylene oxide. As is illustrated in the working examples, it is possible with these cellulosic thickeners to prepare clear medium viscosity fabric softening compositions depending on the amount of thickening agent used.

The second group encompasses certain so-called associative thickeners. Particularly suitable associative thickeners are ethoxylated fatty alcohol polyurethane compounds. The thickening efficacy depends on the number of urethane ethoxylations and the fatty alcohol chain length. Suitable results are obtained when using Thickener 71496 (ex BASF; Germany) and Accusol 880 (ex Röhm & Haas; Germany). As is illustrated in the working examples, it is possible with Thickener 71496 to prepare clear medium viscosity fabric softening compositions.

The third group suitable to be used as thickener in the fabric softener compositions of the present invention are cationic polyacrylate copolymers. Good results are obtained with compositions wherein the thickening agent is a cationic polyacrylate polymer obtained by co-polymerization of trimethyl amino ethyl methacrylate monomers, (meth)acrylate monomers and acrylamide monomers, which co-polymers are optionally crosslinked. Particularly suitable cationic polyacrylate polymers are obtained by polymerization of trimethyl amino ethyl methacrylate monomers, (meth) acrylate monomers and acrylamide monomers to obtain co-polymers that are optionally crosslinked. The co-polymers are quaternized. Low cationicity, which means a cationicity derived from 10–50 mole. % trimethyl aminoethyl methacrylate is needed to achieve the viscosity aimed at. Any crosslinking, if present, should be limited to less than 100 ppm crosslinker present in the preparation process for this thickener. The thickening efficacy depends on the charge density, the crosslinking degree and to a lesser extent on the molecular weight. Suitable results are obtained with C1030 (ex Ciba; Switzerland).

In preferred embodiments, the thickening agent is selected from the group consisting of modified cellulosic polymer, cationic polyacrylate copolymer and mixtures thereof.

Typical formulations within the scope of the present invention are described in the following table:

| Ingredients | Regular | Ultra |
|---|---|---|
| Water | → 100% | → 100% |
| Oligomeric | 4–6% | 12–18% |
| Esterquat | 0.3%–0.4% | 1.2%–1.8% |
| Perfume | 0.1% | 0.1% |
| Sequestring Agent | 0.06% | 0.06% |
| Preservative | Q.S. | Q.S. |
| Thickening agent | | |

The term "regular" refers to a formulation that is ready to be added to a washing machine; the term "ultra" refers to a concentrated formulation that needs dilution before use. Any percentages given in this table and in the present description in general refer to percentages by weight drawn to the total composition (unless otherwise indicated).

In a particularly preferred embodiment, the medium viscosity fabric softening composition of the invention is clear. This means that such a composition is free from visible turbidity and is transparent.

It is especially surprising that concentrated medium viscosity fabric softening compositions can be obtained which are stable without requiring viscosity controllers which are proposed in EP-A-1 136 471. More in detail, this means that medium viscosity fabric softening compositions can be obtained which do not contain any added organic solvents, which do not contain any added electrolyte, and which do not contain any added organic solvents in combination with any added electrolyte. Some organic solvent may be present in the active ingredients of the compositions of the invention. By the terms "do not contain any added organic solvents" it is meant that the total composition contains less than 3 wt. % organic solvent, preferably less than 2.0 wt. % solvent. Some electrolyte may be present in the active ingredients of the compositions of the invention. By the terms "do not contain any added electrolyte" it is meant that the total composition contains less than 0.1 wt. %, preferably less than 0.05 wt. %, and more preferably less than 0.01 wt. % electrolyte.

Figure 2:
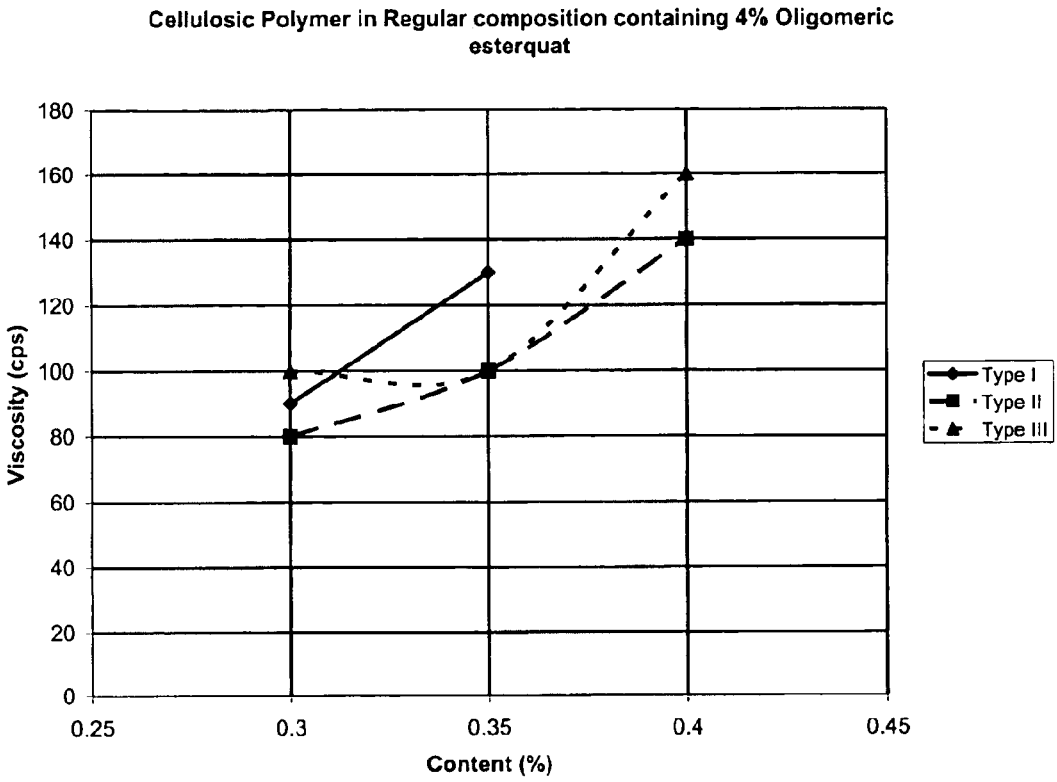
Figure 3:
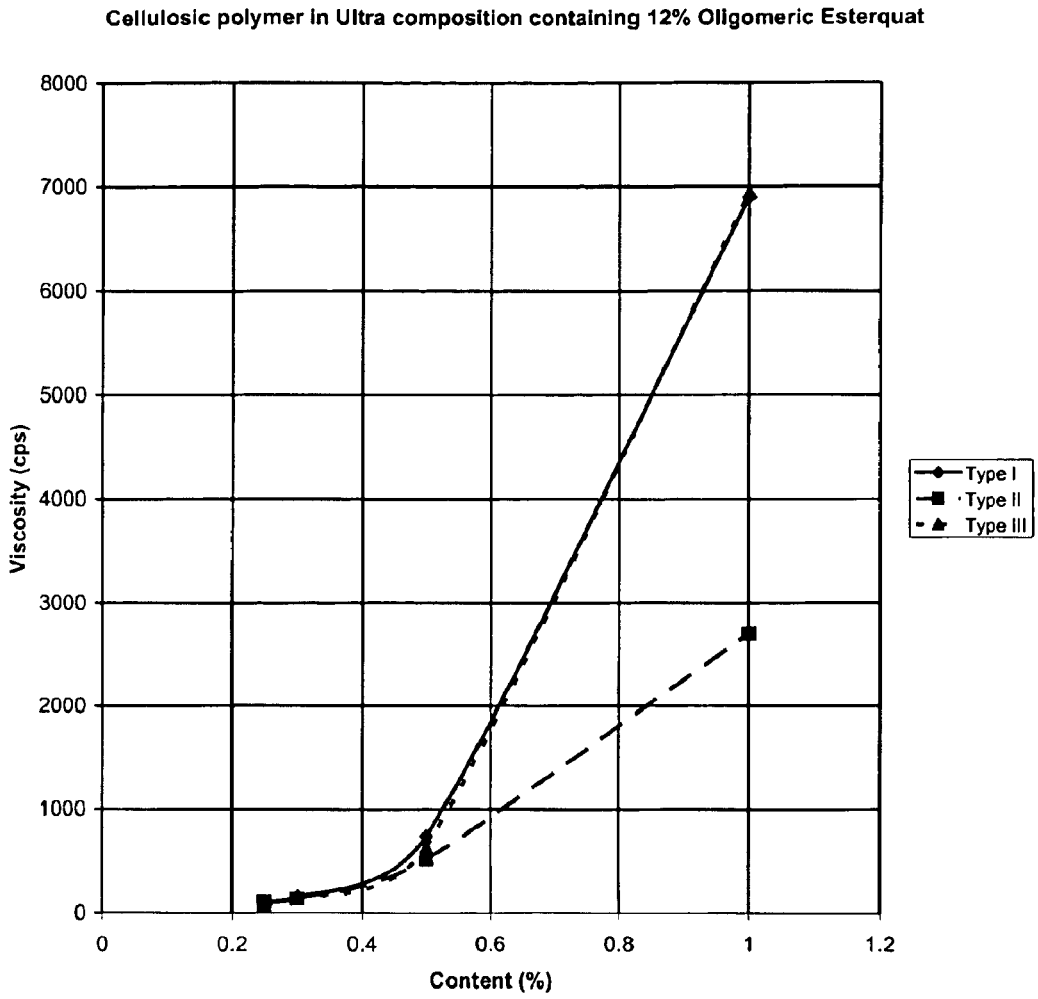

The invention will be described in more detail in the following examples, which do not limit the invention, but merely illustrate the invention. In the working examples, reference will be made to the drawings wherein FIG. 1 is a graph showing the viscosity (in cps (mPa.s)) as a result of the ratio ethylene oxide groups/fatty acid carbons in the chain; and FIGS. 2 and 3 show graphs showing the viscosity (in cps (mPa.s)) as a result of the amount of cellulosic polymer.

EXAMPLE 1

Dispersions of oligomeric esterquats, and particularly of Tetranyl CL518 (ex KAO), in water were prepared, according to the following process: water is heated to a temperature of 60° C.±2° C.; the oligomeric esterquat is melted at a temperature of 60° C.; it is added in molten state in the hot water under stirring; perfume is added; the mixture is cooled down to 25° C.; preservative and a conventional sequestrant are added. By this process products are obtained which have a viscosity of about 40 mPa.s.

In order to make formulations having higher viscosities, thickening agent is added in the water phase or after the cooling step depending of the chemical nature and the physical form.

EXAMPLE 2

Associative Thickener

These polymers are ethoxylated polyurethanes.

As associative thickeners are used: Thickener 71496 (BASF), and Accusol 880 (Röhm & Haas).

The addition of 5% of associative thickener increases the viscosity up to gelification (about 10,000 cps) of the Ultra product.

The addition of associative thickener allows increasing the viscosity of regular compositions containing 4% of oligomeric esterquat, and the viscosity is a function of the associative thickener content.

| Ethoxylated Polyurethane (%) | Supplier | Viscosity (cps) | Aspect |
|---|---|---|---|
| | Regular 4% Dispersion | | |
| 2.5 | BASF | 60 | Clear |
| 3.0 | BASF | 150 | Clear |
| 3.5 | BASF | 530 | Clear |
| 1.5 | Rohm & Haas | 80 | Turbid |
| 2.0 | Rohm & Haas | 240 | Turbid |
| 3.0 | Rohm & Haas | 880 | Turbid |
| | Ultra 12% Dispersion | | |
| 2.5 | BASF | 60 | Clear |
| 3.0 | BASF | 100 | Clear |
| 2.5 | Rohm & Haas | 120 | Turbid |

If the thickening effect is considered only, both samples are satisfactory and allow achieving medium viscosity at a minimal level of 3.0%

If additionally clarity is desired for the compositions to be prepared, the ethoxylated polyurethane obtained from BASF is most suitable.

EXAMPLE 3

Polyacrylate Polymers

The following polyacrylate polymers were tested:

| Supplier | Product | Level (%) | Formula | Viscosity | Aspect |
|---|---|---|---|---|---|
| BP Chemicals | Polymer 7050 | 0.2 | Regular | 140 cps | Turbid |
| Röhm | Rohagit K720 | 0.2 | Concentrate | 30 cps | Clear |
| | | 0.4 | Concentrate | 40 cps | Clear |
| | | 0.2 | Regular | 40 cps | Clear |

-continued

| Supplier | Product | Level (%) | Formula | Viscosity | Aspect |
|---|---|---|---|---|---|
| SNF | Flosoft | 0.2 | Concentrate | 20 cps | Turbid |
| | DP/PSD200 | 0.2 | Regular | 20 cps | Turbid |
| Ciba | C998 | 1.0 | Concentrate | 300 cps | Turbid |
| | | 0.5 | Concentrate | 120 cps | Turbid |
| | C999 | 1.0 | Concentrate | 180 cps | Turbid |
| | C1030 | 1.0 | Concentrate | 360 cps | clear |

The addition of polyacrylate polymer allows increasing the viscosity of regular compositions containing 4% of oligomeric esterquat, and the viscosity is a function of the polyacrylate polymer content.

Two types of polyacrylate co-polymers allow increasing the viscosity. The products are turbid. These types are the copolymers obtained from BP and Ciba. Particularly, Polymer 7050 is a copolymer obtained by copolymerisation of methacrylate, acrylamide and about 80% trimethylaminoethyl methacrylate; it is crosslined with 5–45 ppm bismethacrylamide. Both Ciba polymers have the same cationicity as Polymer 7050 and have low to very low crosslinking.

The homopolymer (Rohagit K720; polymethacrylate) does not achieve medium viscosity, as well as the Flosoft co-polymer (Flosoft is a copolymer obtained by copolymerising methacrylate, acrylamide and 92 mole-% trimethyl aminoethyl methacrylate; it is crosslinked by using more than 150 ppm bismethylacrylamide).

So, medium viscosity is achievable with polyacrylate co-polymers in turbid products an with polyacrylates of very low cationicity in clear products.

EXAMPLE 4

Modified Cellulosic Polymers

In this example, it is shown that the addition of modified cellulosic polymer allows increasing the viscosity of regular compositions containing oligomeric esterquat, and that the viscosity is a function of the modified cellulosic polymer content.

The following modified cellulose polymers ex Hercules (under the trade name Natrosol) are tested:

Type I is Natrosol HHX: Very high molecular weight, extra fine powder;

Type II is Natrosol HHXR: same as HHX with delayed hydration;

Type III is Natrosol HHBR: same as HHXR with a better bio-stability.

| Content | Type I | Type II | Type III |
|---|---|---|---|
| Regular composition: 4% oligomeric esterquat | | | |
| 0.30 | 90 | 80 | 100 |
| 0.35 | 130 | 100 | 100 |
| 0.40 | | 140 | 160 |
| Ultra composition: 12% oligomeric esterquat | | | |
| 0.25 | 110 | 110 | 80 |
| 0.30 | 160 | 140 | 150 |
| 0.50 | 740 | 520 | 640 |
| 1.00 | 6900 | 2700 | 6950 |

From the results it can be concluded that modified cellulosic polymers allow adjusting viscosity of regular and ultra compositions to medium and high viscosity values, at a low level of polymer.

All the thickened compositions are clear except the Natrosol type III at 1.0%.

What is claimed is:

1. A medium viscosity clear fabric softening composition, comprising (a) from about 1 to 20 wt. % of an oligomeric esterquat, derived from the reaction of an alkanol amine with (i) a polycarboxylic acid; and (ii) a fatty alcohol or a fatty acid; or (iii) a mixture of a fatty alcohol and a fatty acid, followed by partial quaternization (leading to a mixture of oligomeric esteramine and of esterquat);

(b) at least about 0.2 wt. % dipropylene glycol, said fabric softening composition being free of isopropanol, ethylene glycol, propylene glycol and polyglycols;

(c) an effective amount of a water insoluble perfume;

(d) an effective amount of a thickening agent to provide a viscosity of from 80 to 700 mPa.s in the softening composition, said thickening agent being selected from the group consisting of (i) non-ionic water-soluble cellulosic polymer derived from the condensation of cellulose and ethylene oxide and/or propylene oxide; (ii) ethoxylated and/or propoxylated fatty alcohol polyurethane associative thickener; and (iii) cationic polyacrylate copolymer; and (e) balance water.

2. The medium viscosity fabric softening composition of claim 1, comprising from about 8 to 20 wt. % of said oligomeric esteramine or oligomeric esterquat with less than about 0.05% electrolytes and/or less than about 3% organic solvent.

3. The medium viscosity clear fabric softening composition of claim 2, which comprises from about 15 to 20 wt. % of oligomeric esterquat.

4. A medium viscosity clear fabric softening composition of claim 1, which contains at least about 0.7 wt. % of said perfume.

5. The medium viscosity clear fabric softening composition of claim 1, wherein the thickening agent is a non-ionic water-soluble cellulosic polymer derived from the condensation of cellulose and ethylene oxide.

6. The medium viscosity clear fabric softening composition of claim 1, wherein the thickening agent is cationic polyacrylate polymer obtained by co-polymerization of trimethyl amino ethyl methacrylate monomers, (meth)acrylate monomers and acrylamide monomers, which co-polymers are optionally crosslinked.

7. The medium viscosity fabric softening composition of claim 1, wherein the thickening agent comprises ethoxylated fatty alcohols having a fatty chain length varying from 10 to 15 (in average) carbon atoms, and wherein the number of ethoxylation varies from 2 to 8 (in average).

8. The medium viscosity clear fabric softening composition of claim 7, wherein the ethoxylation ratio of the EO number to the carbon atoms in the chain length of the fatty alcohol is at least about 0.3.

9. The fabric softening composition of claim 1 which comprises from about 0.2 to 2.5 wt % of said perfume.

10. A process for the manufacture of a stable medium viscosity fabric softening composition, said composition comprising (a) from about 1 to 20 wt. % of an oligomeric esterquat, obtainable by reaction of an alkanol amine with (i) a polycarboxylic acid; and (ii) a fatty alcohol or a fatty acid; or (iii) a mixture of a fatty alcohol and a fatty acid, followed by partial quaternization (leading to a mixture of oligomeric esteramine and of esterquat); (b) at least about 0.2 wt % dipropylene glycol; and wherein said fabric softening composition is free of isopropanol, ethylene glycol, propylene glycol and polyglycols; (c) an effective amount of a water insoluble perfume; (d) an effective amount of a thickening agent to provide a viscosity of from 80 to 700 mPa.s in the softening composition, said thickening agent being selected from the group consisting of (i) non-ionic water-soluble cellulosic polymer derived from the condensation of cellulose and ethylene oxide and/or propylene oxide; (ii) ethoxylated and/or propoxylated fatty alcohol polyurethane associative thickener; and (iii) cationic polyacrylate copolymer; and (e) balance water; said process comprising:

(a) melting said oligomeric esterquat in said water at a temperature of at least 40° C.;

(b) adding said water-insoluble perfume to the esterquat melt of step (a) to form a premix;

(c) dispersing in said water the premix of step (b) and said dipropylene glycol at a temperature of at least 40° C. to form a mixture; and (d) thereafter cooling the mixture of step (c) to about ambient temperature; and wherein said effective amount of thickening agent is added to the mixture of step (c) or to the mixture of step (d) to form a stable, clear medium viscosity fabric softening composition.

11. The process of claim 10 wherein said fabric softening composition contains from about 0.2 to about 2.5 wt % of said perfume.

12. The process of claim 10 wherein the fabric softening composition comprises from about 8 to about 20 wt % of said oligomeric esteramine or oligomeric esterquat with less than about 0.05 wt % electrolytes and/or less than about 3 wt % organic solvent.

* * * * *